United States Patent [19]

Misumi et al.

[11] 4,208,208

[45] Jun. 17, 1980

[54] NICKEL ALLOY BASE METAL PLATE FOR DIRECTLY HEATED OXIDE CATHODES

[75] Inventors: Akira Misumi; Masaharu Kumada, both of Mobara, Japan

[73] Assignee: Hitachi, Ltd., Japan

[21] Appl. No.: 961,272

[22] Filed: Nov. 16, 1978

[30] Foreign Application Priority Data

Nov. 18, 1977 [JP] Japan ..... 52-137908

[51] Int. Cl.[2] ..... H01J 1/15; H01J 19/06

[52] U.S. Cl. ..... 75/170; 75/134 V; 313/345; 313/346 R; 428/680

[58] Field of Search ..... 75/170, 134 V; 313/345, 313/346 R; 428/680

[56] References Cited

U.S. PATENT DOCUMENTS

| | | | |
|---|---|---|---|
| 2,720,458 | 10/1955 | Kates | 75/170 |
| 2,833,647 | 5/1958 | Hoff et al. | 75/170 |
| 2,858,207 | 10/1958 | Warin | 75/170 |
| 3,674,710 | 7/1972 | Richter et al. | 252/465 |
| 3,745,403 | 7/1973 | Misumi | 313/341 |
| 3,902,093 | 8/1975 | Weiss | 313/345 |
| 3,922,428 | 11/1975 | Cronin | 428/312 |
| 4,079,164 | 3/1978 | Misumi | 428/353 |
| 4,081,713 | 3/1978 | Misumi | 313/346 R |

*Primary Examiner*—L. Dewayne Rutledge
*Assistant Examiner*—Upendra Roy
*Attorney, Agent, or Firm*—Craig & Antonelli

[57] ABSTRACT

Base metal plate materials comprising nickel as a main component, rhenium and tungsten, and if desired, a small amount of at least one reducing agent can be used for producing quick operating type directly heated oxide cathodes showing no peeling of the oxide layer from the base metal and having excellent mechanical strength at high temperatures and specific electric resistance.

7 Claims, 1 Drawing Figure

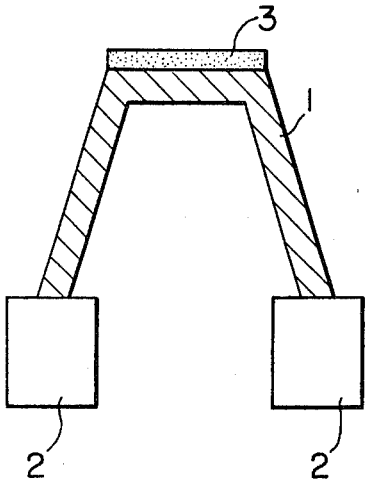
3
1
2
2

NICKEL ALLOY BASE METAL PLATE FOR DIRECTLY HEATED OXIDE CATHODES

This invention relates to a base metal plate material for a directly heated oxide cathode.

A prior art and the invention and the advantages of the latter will be described in detail with reference to the attached drawing which shows a sectional view of the principal part of an example of directly heated oxide cathodes.

As a cathode for a television picture tube, there has been mainly used an indirectly heated cathode wherein a time required for the appearance of an image from the beginning of receiving a television signal is shortened by always allowing flow of a preheating electric current through a heater even during a non-operation period and by raising a heater current value to a rating value at the time of receiving the television signal. But recently, from the viewpoint of saving energy, a quick operating type cathode which requires no preheating but a short time from the beginning of a heater current flow to the appearance of the image has been required. In the indirectly heated cathode, it generally requires about 20 seconds from the beginning of a heater current flow to the appearance of the image in the case of no flow of a preheating current. On the other hand, in the directly heated cathode wherein a so-called oxide for electron emission is directly coated on a heating element, the time required for the appearance of the image from the beginning of a heating current flow can be shortened to 1 to 2 seconds if properly designed. Such a cathode is suitable for the quick operating type cathode.

In the drawing, numeral 1 denotes a base which is heated by the supply of an electric current, numeral 2 denotes terminals for supplying the electric current, and numeral 3 denotes a so-called oxide. In order to improve the quick operating property of the cathode, it is necessary to use as the base 1 a material having high specific electric resistance so as to consume much electric energy in a small part of the electric current path. In order to control the temperature of the base made of such a material as mentioned above within a temperature range suitable for an oxide cathode, the base should have a form which has a longer periphery with respect to the cross-sectional area surrounded by the periphery. Therefore, the base is preferably made, for example, of a thin strip of such a material as mentioned above having a thickness of 100 μm or less, more preferably 60 μm or less. Thus, the material for the base should have sufficient mechanical strength at high temperatures in order to maintain the form having such a cross-section as mentioned above within the cathode operating temperature range. Moreover, the base material should have, as one of its important properties, the property of being suitable for causing sufficient electrons for a long period of time to be emitted from one or more so-called oxides such as barium oxide or a mixture of barium oxide and other oxides of alkaline earth metals, e.g. Ca, Sr, etc. coated on the surface of the base.

As materials which almost meet such conditions, alloys containing nickel as a main component together with either one or both of tungsten and molybdenum which are excellent in heat resistance and trace amounts of one or more reducing agents have been used experimentally and experientially as a base metal for directly heated oxide cathodes (e.g. Japanese Patent Appln. Kokai (Laid-Open) Nos. 57771/77, 39054/78 and 39055/78). But when such alloys were used as the base, there arose many problems such as a large amount of a so-called interface layer due to tungsten or molybdenum being produced between the base and the oxide layer during the picture tube production process or the usage of the thus produced picture tube, and more often resulting in peeling of the oxide layer. On the other hand, the use of rhenium containing alloys as a base metal plate material is also disclosed in Symp. on Rhenium, May 3–4, 1960 Chicago III, Elsevier Publishing, pages 175–180; U.S. Pat. No. 2,858,207; and Advances in Electron Tube Techniques, pages 6–9, 1963. But these alloys are insufficient in performance such as to maintain an electron emissive ability of the oxide cathode.

It is an object of the present invention to provide base metal plate materials for directly heated oxide cathodes overcoming such defects as mentioned above. In order to attain such an object in the present invention, rhenium which does not form an interface layer by itself between the base and the oxide layer is added to a nickel-tungsten alloy for improving mechanical strength at high temperatures and specific electric resistance.

The present invention provides a base metal plate material for a directly heated oxide cathode which comprises nickel as a main component, rhenium and tungsten, and if desired, a small amount of at least one reducing agent.

In the present invention, the base metal plate is made of an alloy comprising nickel as a main component, rhenium and tungsten.

A preferable amount of rhenium in the alloy is in the range from 4 to 17% by weight. If the amount of rhenium is too low, mechanical strength at high temperatures and specific electric resistance of the base become insufficient, while if the amount of rhenium is too much, rhenium is to be precipitated in the course of repeating temperature rise and cooling.

A preferable amount of tungsten in the alloy is in the range from 1 to 6% by weight. The presence of tungsten in such a range as mentioned above does not cause formation of an interface layer due to tungsten and peeling of the oxide layer. Since tungsten functions in such a manner as to maintain an electron emissive ability of the oxide cathode after the exhaustion of the reducing agent if contained or from the beginning if the reducing agent is not contained, the presence of tungsten produces very desirable results. If the amount of tungsten is too low, the effect of tungsten as mentioned above is insufficient, while if the amount of tungsten is too much, an interface layer due to tungsten is to be formed.

More preferable amounts of rhenium and tungsten seem to be dependent on mutual effects of these components. For example, when the tungsten content is 6% by weight, a more preferable range of rhenium is from 4 to 14% by weight, and when the tungsten content is 1% by weight, a more preferable range of rhenium is from 9 to 17% by weight. Therefore, the amount of rhenium in the range from 9 to 14% by weight is more preferable irrespective of the tungsten content in the range of 1–6% by weight. More in detail, when the proportion of tungsten changes from 1 to 6% by weight, a lower limit of the more preferable range of rhenium changes from 9 to 4% by weight linearly, whereas an upper limit of the more preferable range of rhenium changes from 17 to 14% by weight linearly.

The amount of nickel in the alloy is the rest of the total of rhenium and tungsten.

The base metal alloy may further contain at least one reducing agent such as zirconium, magnesium, silicon, aluminum and the like. In the case of zirconium, it is preferable to use zirconium in an amount of 5–6% by weight or less based on the weight of the alloy. If the amount is too much, a eutectic having a lower melting point will be produced to lower mechanical strength at high temperatures. In the case of magnesium, silicon and aluminum, an impurity amount of one or more these reducing agents, corresponding to an amount contained in a conventional base metal for an oxide cathode as an impurity, can usually be used together with or without zirconium.

When a directly heated oxide cathode is produced by using the base metal plate material of the present invention and coating an oxide layer conventionally used, e.g. by using a ternary carbonate mixture comprising $BaCO_3$, $SrCO_3$ and $CaCO_3$, there is no peeling of the oxide layer from the base and there can be obtained a quick operating type directly heated oxide cathode excellent in mechanical strength at high temperatures and specific electric resistance.

The present invention will be explained in detail by way of the following Examples, in which all percents are by weight unless otherwise specified.

EXAMPLE 1

An alloy ingot containing 12% of rhenium, 4% of tungsten, 0.4% of zirconium and the remainder nickel was produced according to a standard powder metallurgy process, and a base metal plate of 30 μm in thickness was formed by cold rolling while the ingot was subjected to vacuum annealing repeatedly. A ternary carbonate mixture of barium, strontium and calcium was coated on the base metal plate thus obtained and subjected to heat treatment at 1000° C. for 10 hours under vacuum to convert the carbonates into the oxides. Adhesive strength of the oxide layer was examined under vacuum by scratching with a pin, and no peeling was produced. The sample was taken out into the air and after removing the oxide layer, interface layers were analyzed by X-ray diffraction. Only an interface layer due to zirconium was detected and no interface layer due to tungsten was detected.

For comparison, a base metal plate of 30 μm thick made of an alloy containing 27.5% of tungsten, 0.4% of zirconium and the remainder nickel was used as a base metal and examined in the same manner as mentioned above. The oxide layer was peeled off. The sample mentioned above was taken out into the air and after removing the oxide layer, interface layers were analyzed by X-ray diffraction. An interface layer due to tungsten as well as an interface layer due to zirconium were detected.

EXAMPLE 2

In the same manner as described in Example 1, the following alloy ingots were used for producing base metal plate.

Run No. 1 Ni 81.6, Re 16, W 2, Zr 0.4 (% by weight) Run No. 2 Ni 81.2, Re 12, W 6, Zr 0.8 In the same manner as described in Example 1, peeling of the oxide layer and formation of interface layers were examined. In individual Run Nos. 1 and 2, no peeling of the oxide layer was produced and only interface layers due to zirconium were detected.

What is claimed is:

1. A base metal plate material for a directly heated oxide cathode which comprises an alloy containing rhenium in the range from 4 to 17% by weight, tungsten in the range from 1 to 6% by weight and the remainder being nickel.

2. A base metal plate material according to claim 1, wherein the amount of rhenium is in the range from 9 to 14% by weight, the amount of tungsten is in the range from 1 to 6% by weight, and the remainder is nickel.

3. A base metal plate material according to claim 1, wherein said base metal plate material has a thickness of 100 μm or less.

4. A base metal plate material according to claim 1 wherein said alloy further contains up to 6% by weight of at least one reducing agent selected from a group consisting of zirconium, magnesium, silicon and aluminum.

5. A base metal plate material according to claim 4, wherein the reducing agent is 6% by weight or less of zirconium.

6. A base metal plate material according to claim 4, wherein said at least one reducing agent is an impurity amount of magnesium, silicon and/or aluminum.

7. A base metal plate material according to claim 5, wherein zirconium is used in an amount of 0.4 to 0.8% by weight.

* * * * *